US006421022B1

(12) United States Patent
Patenaude et al.

(10) Patent No.: US 6,421,022 B1
(45) **Date of Patent: *Jul. 16, 2002**

(54) DUAL BAND HYBRID SOLID/DICHROIC ANTENNA REFLECTOR

(75) Inventors: Yves Patenaude; Timothy E. Durham, both of Palm Bay; James D. Struttmann, Indialantic; Robert C. Taylor, Melbourne; Adam Zaricki, Indialantic; William R. Whaley, Palm Bay; Jay A. Kralovec, Melbourne, all of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/666,008

(22) Filed: Sep. 19, 2000

Related U.S. Application Data

(63) Continuation of application No. 09/392,134, filed on Sep. 8, 1999, now Pat. No. 6,140,978.

(51) Int. Cl.[7] ..... H01Q 15/02; H01Q 19/00

(52) U.S. Cl. ..... 343/781 P; 343/756; 343/909

(58) Field of Search ..... 343/756, 781 R, 343/781 CA, 781 P, 840, 912, 915; 333/134, 202

(56) References Cited

U.S. PATENT DOCUMENTS

| | | | | |
|---|---|---|---|---|
| 4,017,865 A | | 4/1977 | Woodward | 343/781 |
| 4,525,719 A | | 6/1985 | Sato et al. | 343/761 |
| 4,701,765 A | * | 10/1987 | Arduini et al. | 343/897 |
| 5,041,840 A | | 8/1991 | Cipolla et al. | 343/725 |
| 5,160,936 A | | 11/1992 | Braun et al. | 343/725 |
| 5,208,603 A | | 5/1993 | Yee | 343/909 |
| 5,327,149 A | | 7/1994 | Kuffer | 343/720 |
| 5,451,969 A | | 9/1995 | Toth et al. | 343/781 |
| 5,485,167 A | | 1/1996 | Wong et al. | 343/753 |
| 5,485,168 A | | 1/1996 | Parekh | 343/761 |
| 5,497,169 A | | 3/1996 | Wu | 343/909 |
| 5,581,265 A | | 12/1996 | Stirland et al. | 343/756 |
| 5,652,631 A | | 7/1997 | Bullen et al. | 343/872 |
| 5,673,056 A | | 9/1997 | Ramanujam et al. | 343/756 |
| 5,892,485 A | | 4/1999 | Glabe et al. | 343/789 |
| 6,031,506 A | | 2/2000 | Cooley et al. | 343/840 |
| 6,140,978 A | * | 10/2000 | Patenaude et al. | 343/909 |

* cited by examiner

*Primary Examiner*—Tan Ho
(74) *Attorney, Agent, or Firm*—Allen, Dyer, Doppelt, Milbrath & Gilchrist, P.A.

(57) ABSTRACT

A spaceborne hybrid antenna reflector for dual frequency band illumination of common spot beam coverage regions contains an interior solid reflector region, that is adjacent at its perimeter to a ring-shaped exterior dichroic reflector region and adjoined by a common backing structure. The solid interior region is reflective to RF energy at each of first and second spaced apart frequency bands, while the exterior dichroic reflector region is reflective at the first frequency band, but non-reflective at the second frequency band. This allows the hybrid reflector to realize the same beamwidth coverage for a transmitter operating at one frequency band and a receiver operating at the other frequency band. The backing support frame at the rear side of the reflector is electrically decoupled from the exterior dichroic ring.

23 Claims, 7 Drawing Sheets

DUAL BAND HYBRID SOLID/DICHROIC ANTENNA REFLECTOR

This application is a continuation of application Ser. No. 09/392,134 filed on Sep. 8, 1999 now U.S. Pat. No. 6,140, 978.

FIELD OF THE INVENTION

The present invention relates in general to communication systems, and is particularly directed to a hybrid antenna reflector that contains an interior solid reflector region, adjacent at its perimeter to a ring-shaped dichroic reflector region. The solid interior region is reflective to RF energy at each of first and second spaced apart frequency bands, while the dichroic reflector region is reflective at the first frequency band, but nonreflective at the second frequency band. This allows the hybrid reflector antenna to realize the same beamwidth coverage at each of first and second spaced apart frequency bands.

BACKGROUND OF THE INVENTION

Spaceborne reflector antenna systems that have been deployed or proposed to date for multiple spot (terrestrial) coverage illumination at widely separated spectral regions of an elevated frequency band (such as Ka-Band as a non-limiting example) have required separate and differently sized reflector structures for their transmitter (T) and receiver (R) subsystems, in order to achieve the same (T/R) beamwidth coverage per spot. If a geostationary satellite based antenna system is intended to provide simultaneous coverage of a plurality of adjacent terrestrial regions, such as the oval regions diagrammatically shown in the beam pattern coverage map of the United States of FIG. 1, the satellite, such as that shown at 10 in FIG. 2, must be configured to support a limited number of reflector antenna pairs (e.g., four pairs A, B, C, D, or eight individual reflector antennas), each transmit-receiver reflector antenna pair comprising two differently sized antenna reflectors and attendant feed subsystems operating at respectively spaced apart frequency bands.

To provide for spot coverage, such as the example shown in FIG. 1, a number of transmit and receive reflector pairs is required. Furthermore, for accurate spot pointing, it may be required that each reflector be mounted to its own dedicated pointing subsystem. Not only does this add considerable mass and volume to an already physically cumbersome hardware and RF interface problem, particularly where the mounting real estate and payload parameters of spaceborne components are inherently restricted, but substantially increases cost of design and space-deployment.

SUMMARY OF THE INVENTION

In accordance with the present invention, these shortcomings of conventional spaceborne reflector antennas are effectively obviated by a hybrid antenna reflector architecture that is configured to provide the same beamwidth (projected terrestrial spot) coverage at widely spaced apart frequency bands, so that only one reflector is required to illuminate the same sized spot on the earth for an antenna simultaneously operating at widely spaced apart frequency bands. As will be described, the hybrid antenna reflector of the invention contains a generally circular or polygonal, interior solid parabolic or alternately shaped reflector sector or region, that is adjacent at its perimeter to a generally ring-shaped or annular dichroic reflector sector. Each sector may be constructed of assembled panels using low coefficient of thermal expansion (CTE) composite laminates for structural integrity and for reduced thermal distortion of the reflector surfaces. The solid interior sector is reflective to RF energy at each of a pair of relatively widely spaced apart frequency bands, such as, as a non-limiting example, spectrally separate transmit and receive portions of a given operating band or bands, while the exterior dichroic reflector sector is reflective at a first (e.g., lower) frequency band, but is non-reflective (e.g. transmits or absorbs) at a second (e.g., higher) frequency band. The interior and exterior sectors are aligned such that a continuous RF reflective surface is formed for the first (lower) frequency band.

The inner radial dimension of the exterior dichroic reflector sector is defined so that the effective aperture or beamwidth of the hybrid antenna reflector is the same for each of the two spaced apart bands at which the antenna is intended to operate. This allows a single hybrid antenna reflector to produce one or multiple beam pattern(s) that cover(s) the same illuminated terrestrial region(s), and thereby reduces by a factor of two the number of antennas (reflectors and feeds) that would otherwise have to be mounted on a satellite to obtain simultaneous coverage of a single terrestrial region or a plurality of terrestrial regions.

For structural integrity to the satellite bus, the rear surface of the hybrid antenna reflector architecture of the invention is mounted to a stable backing support structure, such as a generally regular polygon-shaped frame formed of interconnected struts made of a material whose coefficient of thermal expansion is relatively low and compatible with that of the hybrid antenna reflector. The backing frame is integrally joined with the satellite via an actuator coupling joint, which, when combined with an actuator mechanism system, enables deployment and/or proper pointing of the reflector system. The actuator coupling joint may be radially displaced from the exterior perimeter of the exterior dichroic sector, so that it may be readily affixed to an actuator installed on the satellite.

Because it is adjacent to the rear side of the antenna's exterior dichroic sector, the backing frame is a potential reflector of RF energy passing through the exterior dichroic sector. To prevent unwanted reflections by the backing structure, the portion of the backing support frame behind the exterior dichroic sector may be configured to deflect, absorb, transmit, or otherwise minimize reflection of RF energy that has passed through the exterior dichroic sector towards the coverage region.

DETAILED DESCRIPTION

Figure 3:
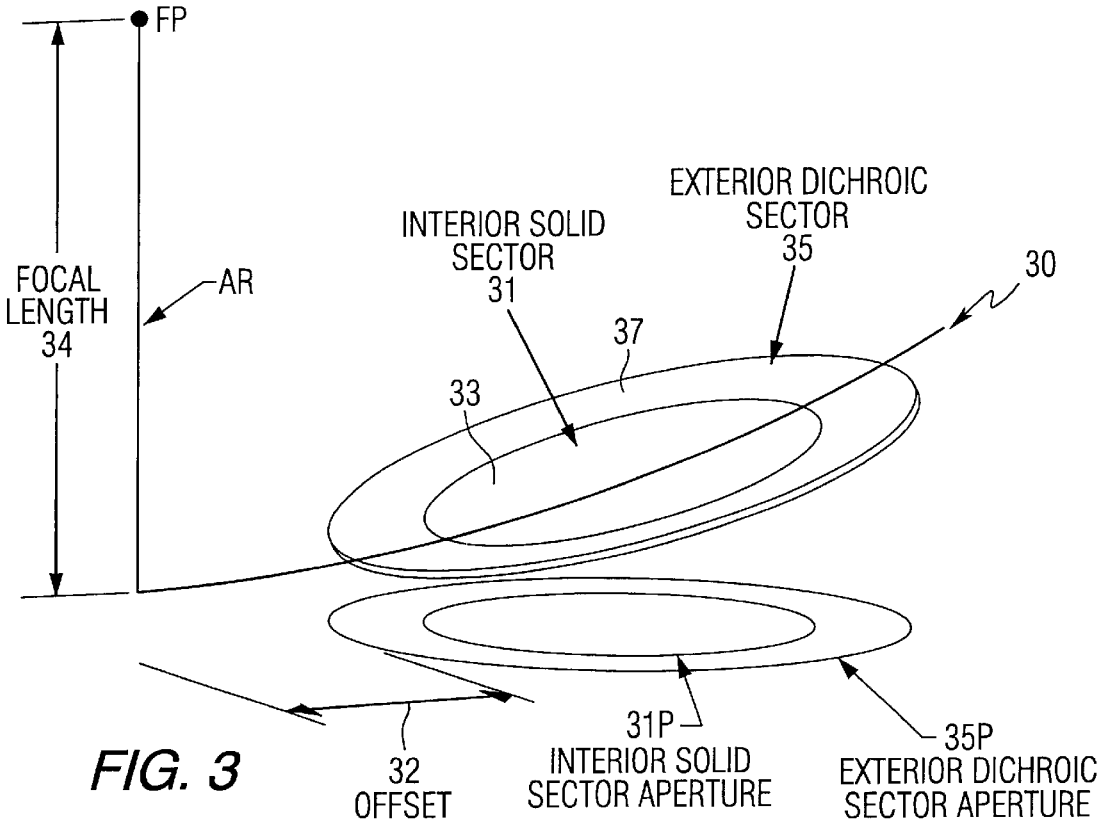
FIG. 3 diagrammatically illustrates a first embodiment of the hybrid antenna reflector architecture of the present invention.

Attention is now directed to FIG. 3, wherein a nonlimiting embodiment of the hybrid antenna reflector architecture of the present invention is diagrammatically illustrated at 30 as comprising a first, generally circular or polygonal, interior solid reflector sector region 31, having a reflective surface 33. The interior solid sector is shaped to provide a desired reflected RF energy distribution, such as, but not limited to a portion of a parabola of revolution, that is offset by a prescribed displacement 32 relative to an axis of revolution AR, and has a focal length 34.

Adjacent to the interior solid sector 31 at its perimeter is a generally ring-shaped or annular, generally circular or polygonal, exterior dichroic reflector sector 35, having a surface 37 that is aligned to form a continuous effective RF reflective surface with the (parabolic or otherwise shaped) surface 33 of the interior solid sector 31. To minimize thermal distortion, each of the sectors 31 and 35 may be formed of a plurality of adjacent segments or panels, separations among which are defined to accommodate deflections due to thermal expansion. FIG. 3 also shows apertures 31P and 35P of the interior solid sector 31 and exterior dichroic sector 35, respectively, projected onto a planar surface normal to the focal axis AR.

The reflective surface 33 of the interior solid sector 31 is solid or effectively continuous, so that it reflects RF energy over both of first and second spaced apart frequency bands. The exterior reflector sector 35 (to be described in detail below with reference to FIGS. 12 and 13), on the other hand, is dichroic or frequency selective, so that it is reflective at a first (lower) frequency band, but is non-reflective (e.g., transmissive or absorptive) at a second (higher) frequency band, that is spectrally spaced apart from the first frequency band. The interior solid sector 31 and the exterior dichroic sector 35 are aligned such that a continuous RF reflective surface is formed for the first (lower) frequency band.

The inner radial dimension of the exterior dichroic sector 35 is defined so that the effective aperture or beamwidth of the hybrid antenna reflector 30 is the same for each of the two spaced apart bands at which the antenna is intended to operate. This allows a single hybrid antenna reflector according to the invention to be coupled with dual-band feeds capable of operating at both spaced apart frequency bands, and produce the same spot beam pattern for both frequency bands.

Figure 2:
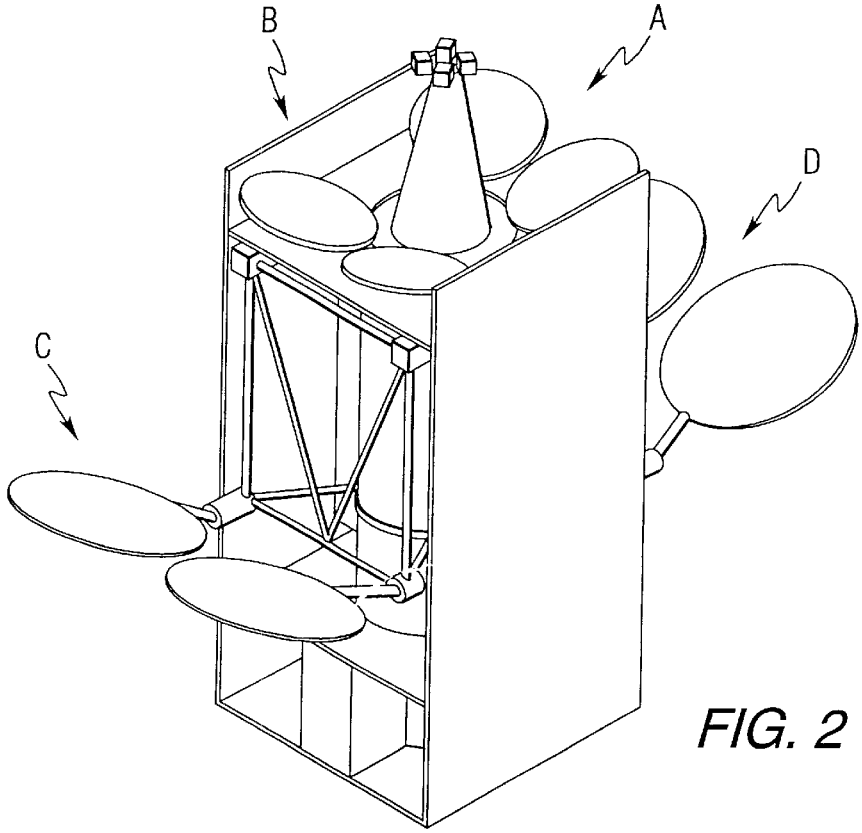
FIG. 2 diagrammatically illustrates an example of a satellite configuration which has four pairs of differently sized antenna reflectors and single band,feed subsystems, operating at the respectively spaced apart frequency sub-bands for providing beam spot coverage of the plurality of oval regions in the beam pattern coverage map example of FIG. 1.
Figure 4:
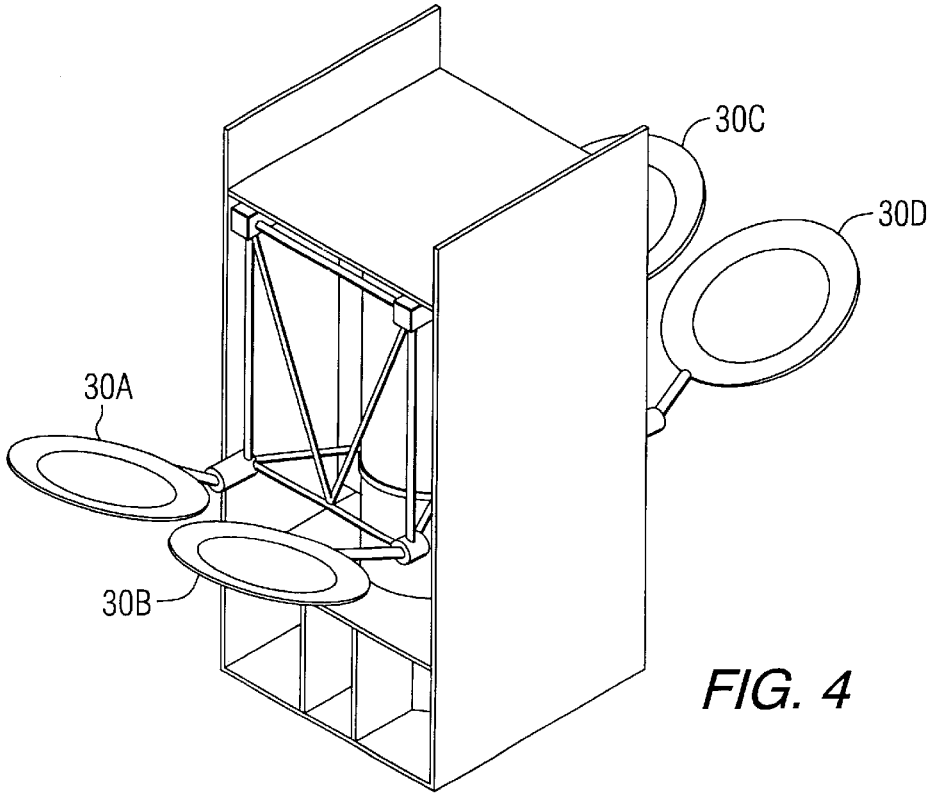
FIG. 4 diagrammatically illustrates an example of a satellite configuration which has four hybrid antenna reflectors of FIG. 3 and associated dual-band feed subsystems, operating simultaneously at the spaced apart sub-bands to provide beam spot coverage of the plurality of oval regions in the beam pattern coverage map example of FIG. 1.

As diagrammatically illustrated at 30A, 30B, 30C, 30D in FIG. 4, this reduces by a factor of two the number of antennas and associated hardware that would otherwise have to be mounted on a (geostationary) satellite (such as that in FIG. 2) to obtain simultaneous coverage of a single terrestrial region or a plurality of terrestrial regions. Not only does this significantly decrease the mass and volume of the overall antenna subsystem, but it frees up considerable satellite real estate for other components (e.g., intersatellite link antennas shown in FIG. 4).

Figure 5:
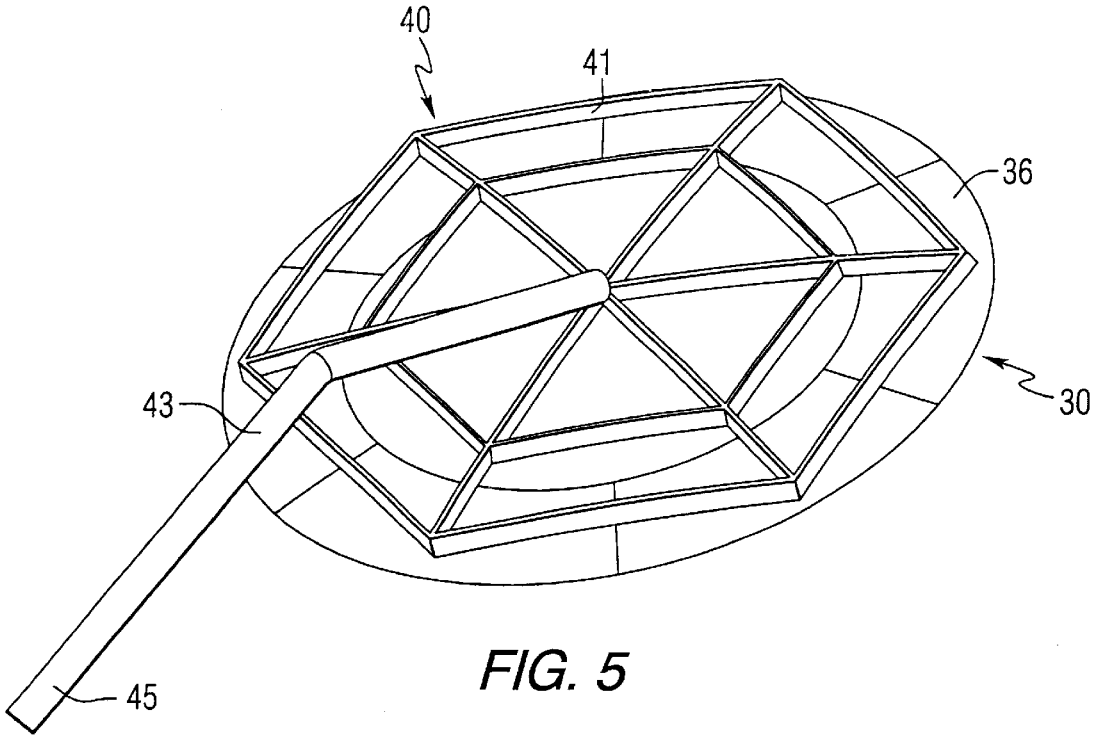
FIGS. 5 and 6 are respective rear and front perspective views of the hybrid antenna reflector of FIG. 3 and an embodiment of its associated backing support structure.
Figure 6:
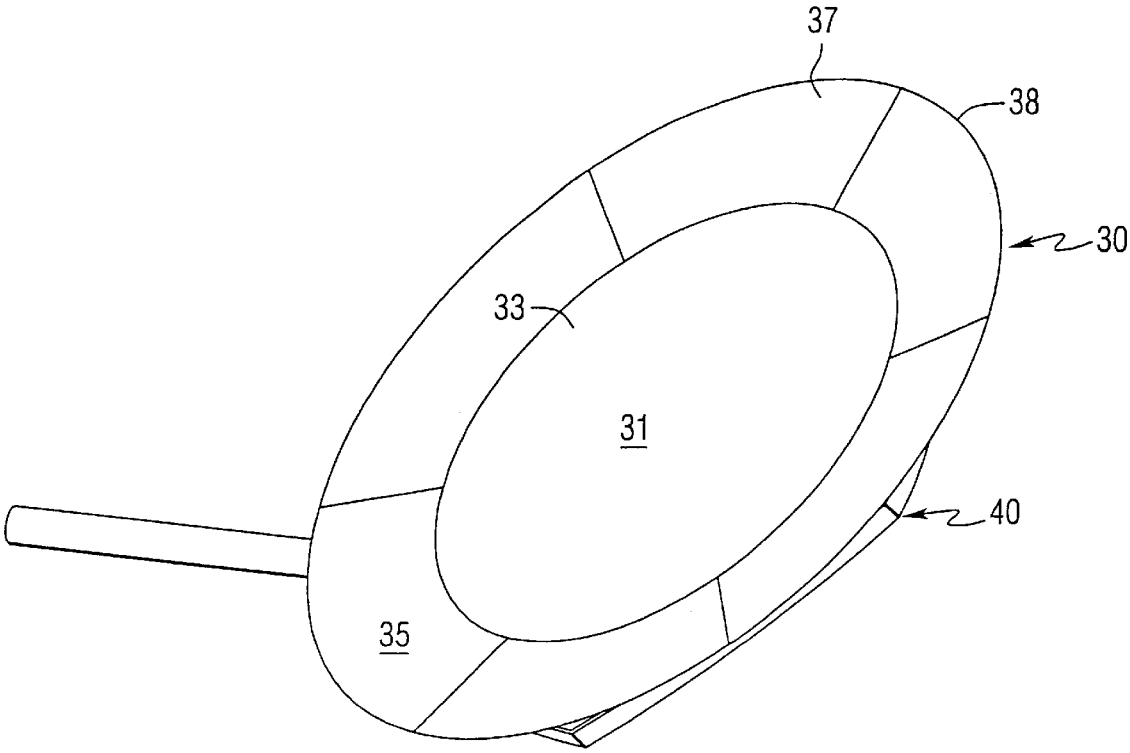
Figure 7:
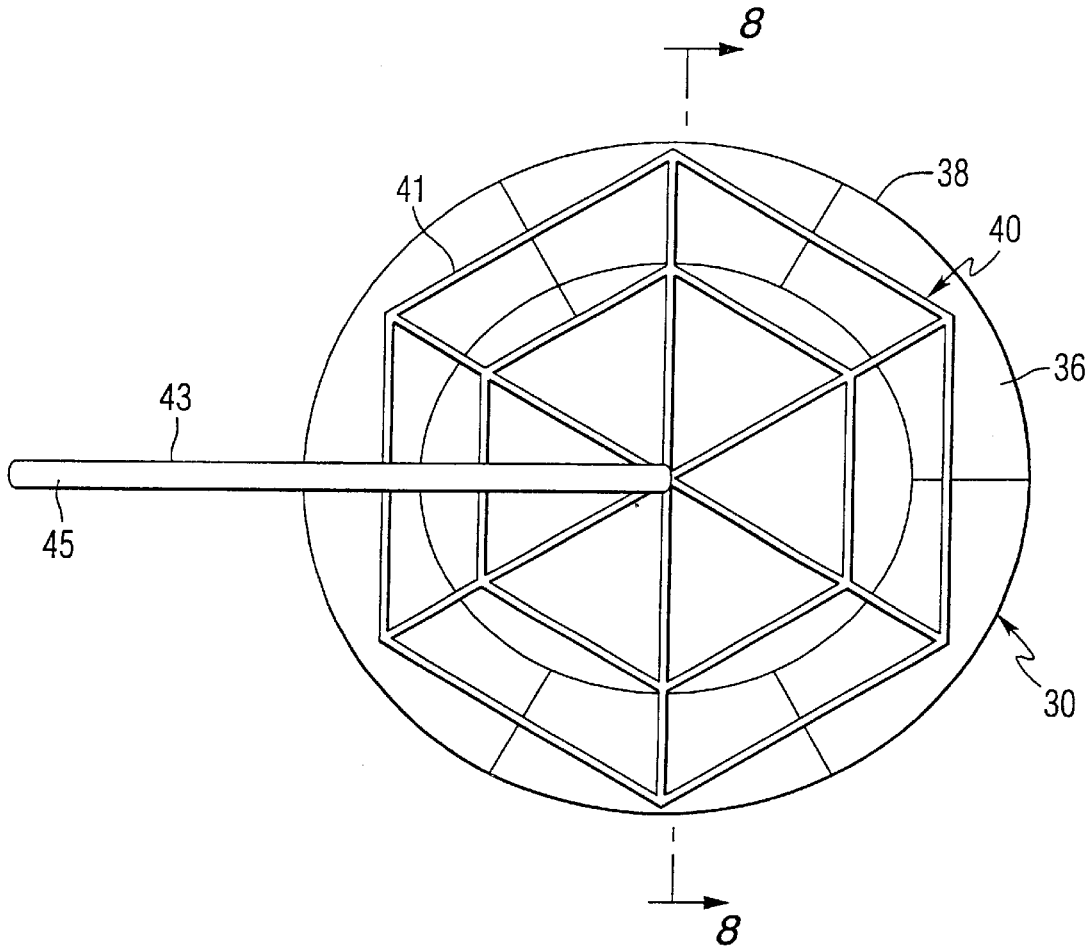
FIG. 7 is a rear view of the hybrid antenna reflector of FIG. 3 and an embodiment of its backing support structure.

FIGS. 5, 6 and 7 diagrammatically illustrate a non-limiting example of a configuration of a stable backing support structure 40, to which the hybrid antenna reflector architecture 30 of FIG. 3 may be mounted for structural connectivity to the satellite bus. As shown therein, the backing support structure 40 may comprise a generally regular polygon-shaped (e.g., hexagonal) frame 41 formed of interconnected struts made of a material whose coefficient of thermal expansion (CTE) is relatively low and compatible with that of the antenna 30. Proper connection of the reflector 30 to the support structure 40 may be made using structural elements (e.g., flexures, clips, or pins) which minimize the thermal distortions resulting from mismatch between the CTE of the reflector and support structure.

The backing frame 41 is sized to be attached to and thereby provide stable structural support for each of the interior solid sector 31 and the exterior dichroic sector 35 of the hybrid antenna reflector 30. The backing frame is integrally joined with the satellite via an actuator coupling joint, which, when combined with an actuator mechanism system, enables deployment and/or proper pointing of the reflector system.

Figure 8:
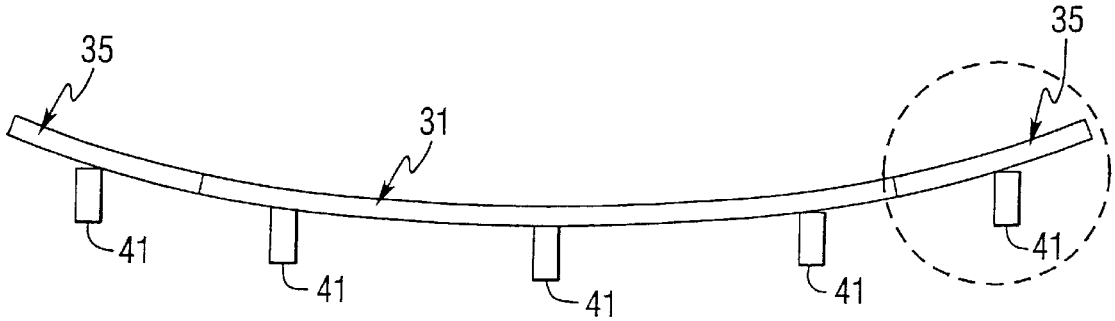
FIG. 8 is a diagrammatic cross-sectional view of the embodiment of FIG. 7.

Because it is adjacent to the rear side 36 of the antenna's exterior dichroic sector 35, the backing frame 41 is a potential reflector of RF energy (e.g., high frequency band energy) passing through the exterior dichroic sector 35. In accordance with a further aspect of the invention, this problem is remedied by configuring the backing support structure (frame 41), a portion of which is shown in the cross-sectional view of FIG. 8, so as to deflect, absorb, or transmit, or otherwise minimize reflection of RF energy that has passed through the exterior dichroic sector 35, and thereby electrically decouple the backing structure from the intended RF reflector functionality of the antenna.

Figure 9:
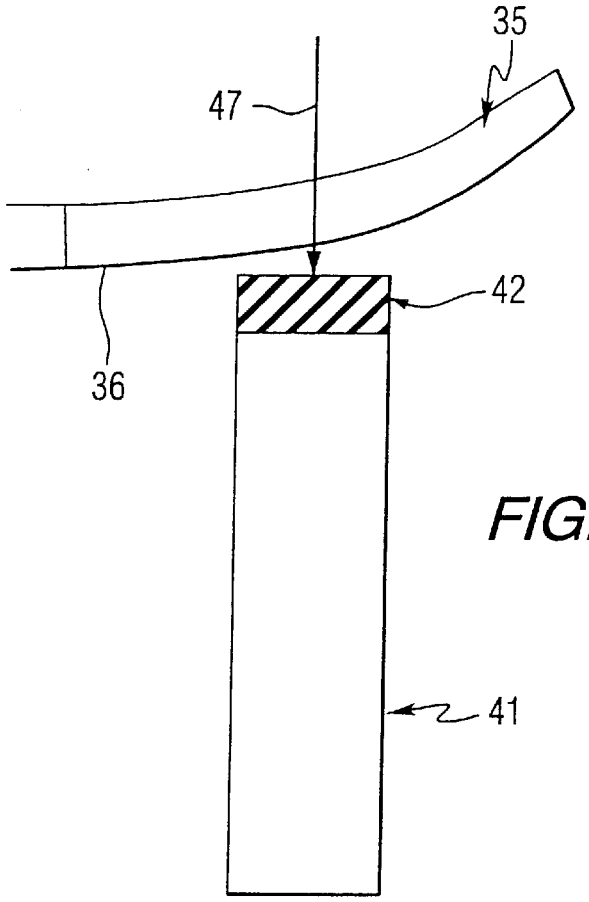
FIG. 9 diagrammatically shows an enlarged cross-sectional view of the exterior dichroic sector where the surface of an antenna backing strut is covered with an RF energy absorbing layer.
Figure 10:
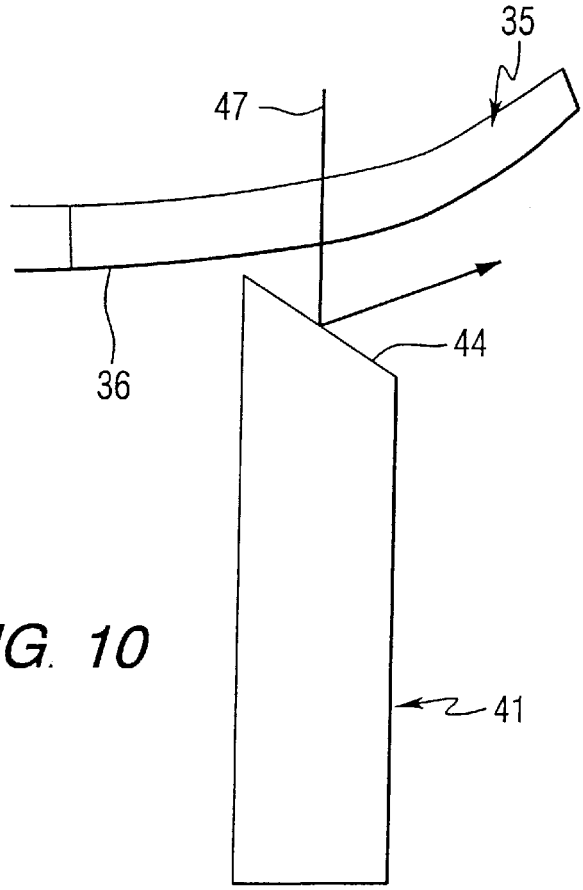
FIGS. 10 and 11 diagrammatically show an enlarged cross-sectional view of the exterior dichroic sector where the respective shapes of the top surface of an antenna backing struts are shaped to deflect incident RF energy away from the antenna coverage region(s)

Pursuant to a non-limiting example, diagrammatically shown in FIG. 9, the surface of that portion of the backing frame 41 located directly adjacent to the rear surface 36 of the exterior dichroic sector 35 is covered with an RF energy absorbing layer 42. In a second approach, shown in FIGS. 10 and 11, the surface of the backing frame 41 is shaped to deflect incident RF energy away from the antenna's single coverage region or plurality of coverage regions. In FIG. 10, the backing frame is shown at 44 as being canted in a generally linear manner away from the rear surface of the dichroic ring, whereas FIG. 12 shows a generally non-linear or curved contour 46. In each of FIGS. 9, 10 and 11, incident RF energy is represented diagrammatically by ray 47.

Figure 11:
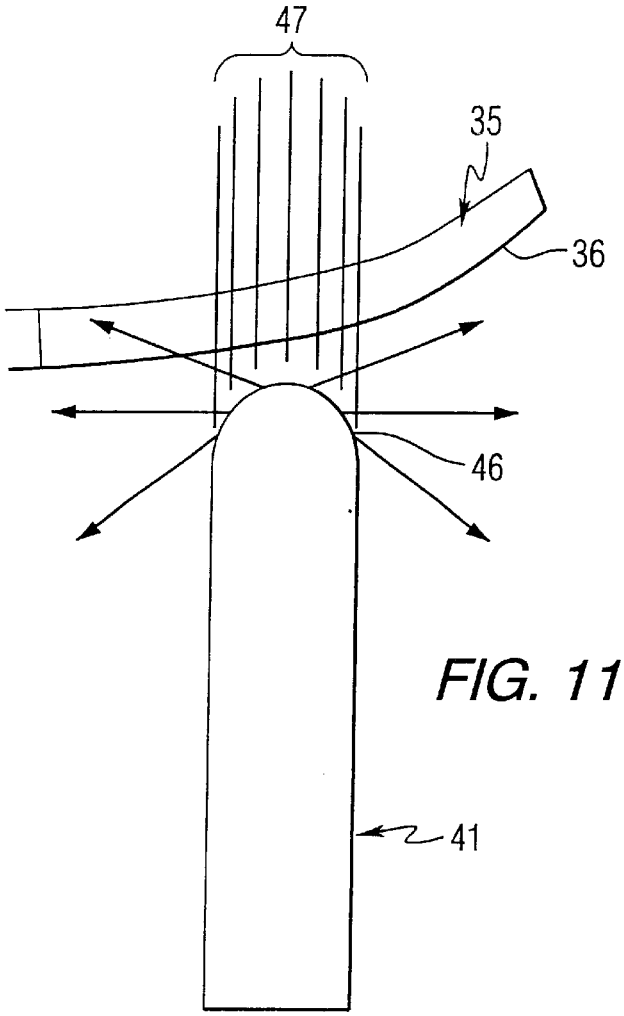
Figure 12:
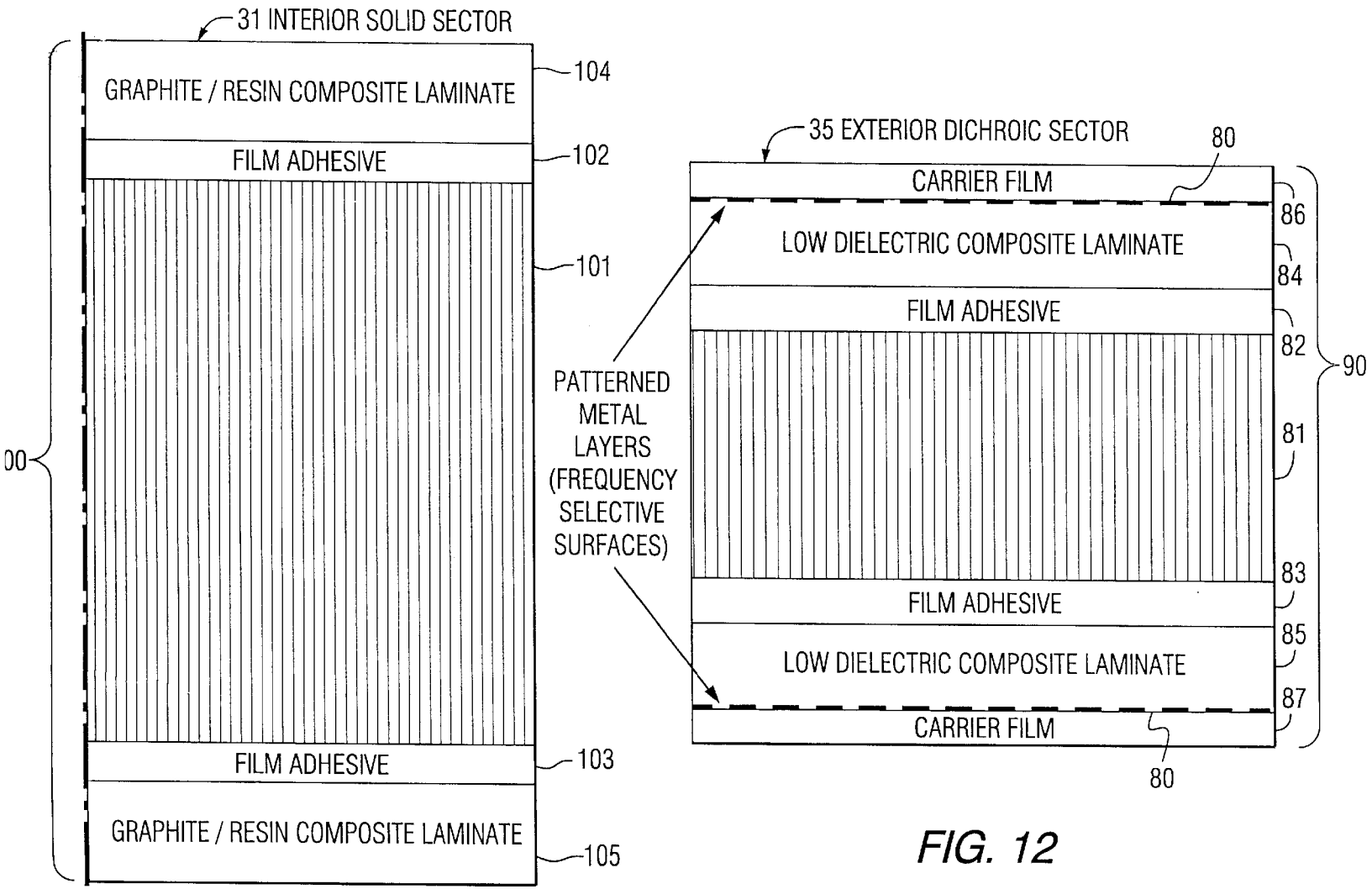
FIG. 12 is a cross-sectional view of an example of the composite construction of the interior and exterior sectors of the hybrid reflector architecture of the invention.

It may be noted that the use of an absorber layer in the embodiment of FIG. 9 may be combined with the deflecting shape embodiments of FIGS. 10 and 11 for enhanced reduction of unwanted reflections. Further approaches include configuring the backing frame 41 with other types structural members having a reduced reflective cross section in the coverage direction, or by using only materials which do not reflect RF energy in the frequency bands of interest for that portion of the backing frame 41 located directly adjacent to the rear surface 36 of the exterior dichroic sector 35.

Figure 13:
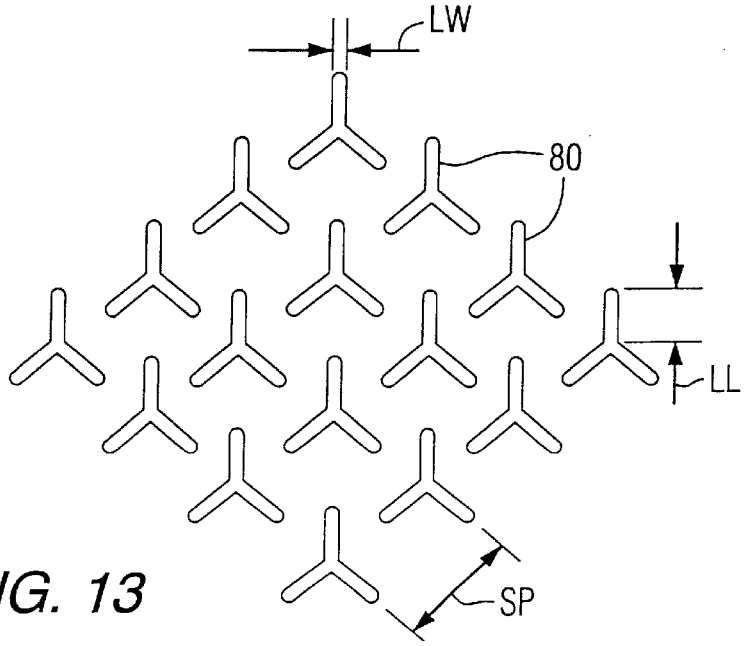
FIG. 13 is an enlarged partial plan view of the patterned metal layers (frequency selective surfaces) within the exterior dichroic cross-sections in FIG. 12.

Attention is now directed to the cross-sectional view of FIG. 12 and the enlarged partial plan view of FIG. 13, which depict a non-limiting example of the composite construction of the hybrid reflector architecture of FIG. 3. Each of the interior solid sector 31 and the exterior dichroic sector 35 may be built up on the contoured surface of a mold that conforms with the geometry of the intended reflector design. As shown in FIG. 12, for structural integrity and thermal stability, the interior solid sector 31 may comprise a honeycomb sandwich structure 100 which may comprise graphite/resin facesheets 104 and 105 (e.g., M5SJ unidirectional graphite tape impregnated with RS-3C polycyanate resin) and honeycomb core 101 (e.g., aluminum core). Opposite surfaces of the honeycomb core 101 are coated with respective layers 102 and 103 of bonding film (e.g., FM73U film adhesive), with the entire structure 100 having a prescribed thickness (e.g., on the order of one-half inch).

Also shown in FIG. 12, a cross-section of the exterior dichroic sector 35 is comprised of a dichroic composite structure 90 containing two frequency selective surfaces with inner and outer dielectric layers. The frequency selective surfaces 80 comprise thin metal layers, such as copper or aluminum, having thicknesses on the order of 0.1 mils, which may be laminated or vacuum-deposited onto the outer dielectric layers 86 and 87. The metal is etched to realize a generally regular, distribution of periodically spaced tripole elements 80, as shown in the enlarged partial plan view of FIG. 13. The outer dielectric layers 86 and 87 comprise a low dielectric carrier, such as kapton or Mylar film on the order of two mils thick. The inner dielectric layers of the dichroic composite structure 90 comprise a low dielectric honeycomb sandwich 81 having a thickness on the order of 0.1 inch and comprising low dielectric facesheets 84 and 85 (e.g., Kevlar 120 cloth impregnated with EX-1515 cyanate ester resin) on the order of 9 mils thick, low dielectric honeycomb core 81 (e.g., Nomex core, on the order of 85 mils thick), and bonded together with low dielectric film adhesive 82 and 83 (e.g., FM73U film adhesive) on the order of four mils thick.

As described above, frequency selectivity at the exterior dichroic sector 35 of the hybrid reflector is provided by making the exterior dichroic sector of a different architecture than the interior sector 31, so that the exterior dichroic sector is non-reflective (e.g., transmissive or absorptive) to RF energy at a second (higher) frequency band, but otherwise reflects RF energy at a first (lower) frequency band. The inner aperture dimension 31P of the exterior dichroic sector 35 is calculated by equating the ratio of the inner to outer aperture dimensions to the ratio of the lower to higher frequency bands of interest.

Figure 1:
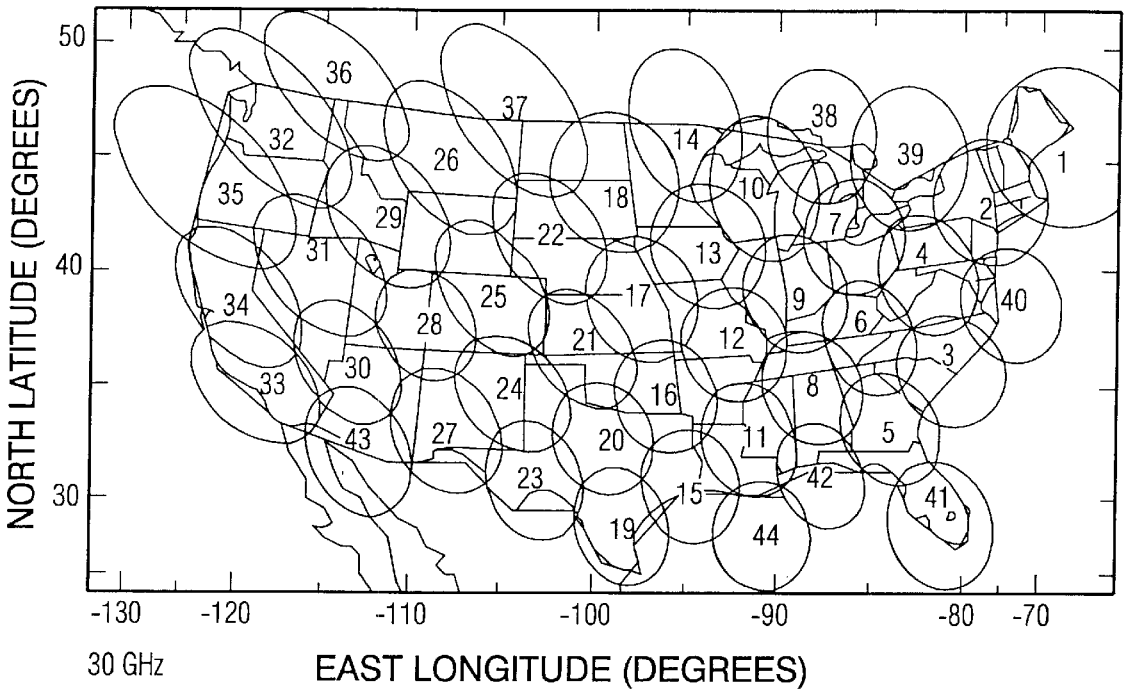
FIG. 1 is a beam pattern coverage map of the United States showing a plurality of spots associated with a terrestrial illumination pattern that may be provided by a geosynchronous satellite based antenna system.

Referring to FIG. 3, as a non-limiting example for a Ka-band system, an outer aperture diameter 35P of 65 inches is selected to achieve the spot beam pattern of FIG. 1 for a transmit band of 18 to 20 GHz. An inner aperture diameter 31P of 43 inches is then selected so that the same spot beam pattern of FIG. 1 is achieved for a receive band of 28 to 30 GHz. Correspondingly for this example, a respective tripole element 80 in FIG. 13 would have a leg length LL on the order of 0.08 inches, a leg width LW on the order of 0.01 inches, and a spatial period SP on the order of 0.1 inches.

As will be appreciated from the foregoing description, shortcomings of conventional spaceborne antenna reflector systems, which require separate transmit and receive reflectors and associated subsystem single band feed and mounting hardware for achieving common terrestrial spot coverage regions are effectively obviated by the hybrid antenna reflector architecture of the present invention, which maintains beam congruency for each of two widely spaced apart frequency bands. This enables the invention to reduce by a factor of two the number of antenna reflectors that would otherwise have to be mounted on a satellite to obtain simultaneous coverage of a single terrestrial region or a plurality of terrestrial regions.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed is:

1. An antenna architecture comprising:

a first reflector formed of a first plurality of adjacent reflector segments that define a first reflector geometry and are effectively reflective to RF energy at first and second spaced apart frequency bands; and a second reflector formed of a second plurality of adjacent reflector segments that define a second reflector geometry, said second reflector being effectively reflective to RF energy at said first frequency band, and effectively non-reflective of RF energy at said second frequency band, said second reflector adjoining said first reflector to form therewith a composite reflector having a composite reflector geometry different from said first reflector geometry.

2. The antenna architecture according to claim 1, wherein said adjacent reflector segments of said first and second reflectors are formed of assembled panels of low coefficient of thermal expansion composite laminate structures that are spaced apart from one another by separations that accommodate deflections due to thermal expansion.

3. The antenna architecture according to claim 1, wherein adjacent segments of said first and second pluralities of adjacent reflector segments of said first and second reflectors are spaced apart from one another by separations that accommodate deflections due to thermal expansion.

4. The antenna architecture according to claim 3, wherein said first plurality of adjacent reflector segments of said first reflector define a generally circular or polygonal geometry that forms an interior solid reflector component of said composite reflector, and wherein said second plurality of adjacent segments of said second reflector define a generally ring-shaped circular or polygonal geometry that forms an exterior reflector component that surrounds and is adjacent to the perimeter of said first reflector.

5. The antenna architecture according to claim 3, wherein said second reflector is effectively transmissive of RF energy at said second frequency band.

6. The antenna architecture according to claim 3, wherein said first frequency band is lower than said second frequency band.

7. The antenna architecture according to claim 6, wherein said first and second reflectors are dimensioned so as to produce effectively the same spot beam coverage regions at said first and second spaced apart frequency bands.

8. The antenna architecture according to claim 3, wherein said second reflector is effectively absorptive of RF energy at said second frequency band.

9. The antenna architecture according to claim 3, further including a support structure for said first and second reflectors, that is configured to reduce reflections towards the coverage area from RF energy passing through said second reflector.

10. The antenna architecture according to claim 9, wherein said support structure is covered with material that absorbs RF energy at said second frequency band.

11. The antenna architecture according to claim 9, wherein said support structure is configured to deflect RF energy in said second frequency band away from the coverage area of said composite reflector.

12. The antenna architecture according to claim 9, wherein said support structure has a reduced reflective cross section in the direction of incidence of RF energy in said second frequency band.

13. The antenna architecture according to claim 9, wherein said support structure is comprised of materials which do not reflect significant RF energy in said second frequency band.

14. An antenna reflector comprising:

a first reflector having a first geometry and being effectively reflective to RF energy at first and second spaced apart frequency bands;

a second reflector formed of a plurality of adjacent reflector segments that are effectively reflective to RF energy at said first frequency band, and effectively non-reflective of RF energy at said second frequency band, said second reflector adjoining said first reflector and forming therewith a composite reflector having a composite geometry different from said first geometry.

15. The antenna reflector according to claim 14, wherein said first reflector is formed of plural reflector segments.

16. The antenna reflector according to claim 14, wherein said first reflector has a generally circular or polygonal geometry that forms an interior solid reflector component of said composite reflector, and said second reflector has a generally ring-shaped circular or polygonal geometry that forms an exterior reflector component that surrounds and is adjacent to the perimeter of said first reflector.

17. The antenna reflector according to claim 14, wherein said second reflector is effectively transmissive of RF energy at said second frequency band.

18. The antenna reflector according to claim 14, wherein said second reflector is effectively absorptive of RF energy at said second frequency band.

19. The antenna reflector according to claim 14, further including a support structure for said first and second reflectors, that is configured to reduce reflections towards the coverage area from RF energy passing through said second reflector.

20. The antenna reflector according to claim 19, wherein said support structure is covered with material that absorbs RF energy at said second frequency band.

21. The antenna architecture according to claim 19, wherein said support structure is configured to deflect RF energy in said second frequency band away from the coverage area of said composite reflector.

22. The antenna reflector according to claim 19, wherein said support structure has a reduced reflective cross section in the direction of incidence of RF energy in said second frequency band.

23. The antenna reflector according to claim 19, wherein said support structure is comprised of materials which do not reflect significant RF energy in said second frequency band.

* * * * *